United States Patent [19]

Brown

[11] 4,363,338

[45] Dec. 14, 1982

[54] LIQUID FILLING MACHINE

[76] Inventor: Albert M. Brown, 3 Blackburn Ave., Elizabeth South, State of South Australia, Australia

[21] Appl. No.: 185,156

[22] Filed: Sep. 8, 1980

[51] Int. Cl.[3] ..... B67C 7/00; B65B 3/04

[52] U.S. Cl. ..... 141/2; 141/5; 141/18; 141/114; 53/381 A; 53/492

[58] Field of Search ..... 141/2, 18, 1, 10, 114, 141/311 R, 313-317, 350, 154, 326, 327, 3-9, 11, 12, 39-67, 37, 18-29; 53/381 A, 50, 434, 510, 492

[56] References Cited

U.S. PATENT DOCUMENTS 3,403,826 10/1968 Buford et al. ..... 141/114

3,516,452 6/1970 Scholle ..... 141/350

*Primary Examiner*—Houston S. Bell, Jr.

[57] ABSTRACT

A liquid filling machine suitable for filling a container, for example with wine, wherein a closure grips the dispensing closure of the container from an intermediate level, lifts it from the container, moves it to one side and at the same time moves the filling head over the now open mouth of the container, lowers the filling head into the container, charges the container with liquid, raises again to the upper level and indexes back to again position the closure above the container, drive the closure back into the container down to the lower level wherein the closure is permanently retained and releases the closure.

11 Claims, 11 Drawing Figures

LIQUID FILLING MACHINE

This invention relates to a filling machine which is useful for filling, with liquid, a container of the type which has a dispensing closure axially movable into or out of a flange sleeve.

Much difficulty has been encountered in achieving the filling of the so called "wine cask" type container, wherein a flexible bag of polymeric material is filled with wine or other product. Such a bag is usually provided with a dispensing closure, usually of the type having a tap which can be turned from one position to another, although other types of dispensing closures are used. Each dispensing closure is provided with a skirt which has a flange near its upper end, a tapered lower end having a shoulder, and intermediate outstanding ribs surrounding it, and the skirt is partially but not fully inserted in the empty bag when it is received. For charging the bag with a product such as wine, the dispensing closure is removed from the flange, the bag is charged with wine from a filling head portion of a head assembly, and the dispensing closure is reinserted. With delicate products such as wine, it is desirable and in some cases essential to evacuate the bag before filling so that there is a minimum of contact of the wine with the oxygen of the air, and in some instances it is also regarded as desirable, if not essential to purge the wine after it has been charged into the bag, and before reinsertion of the dispensing closure, with a comparatively insert gas such as nitrogen.

Machines have been provided which are capable of achieving the results quite efficiently, but they are subject to a number of disadvantages. The main disadvantage with known machines is that they require a large amount of hand operation and considerable operator fatigue results. Another problem is the difficulty of effecting all the operations of withdrawal of the dispensing closure, re-positioning of the head to effect the filling, and re-insertion of the dispensing closure.

BRIEF SUMMARY OF THE INVENTION

Briefly, in this invention, a liquid filling machine is provided with sleeve retaining means on its frame which will retain the flanged sleeve of a container, and is provided with a head assembly which itself comprises a closure grip means for gripping the dispensing closure, and a filling head. The closure grip means grips the dispensing closure and lifts it away from the flanged sleeve, the head assembly indexes in a planar movement to position the filling head over the now open flanged sleeve, the filling head is lowered, the container filled, the filling head lifted away from the flanged sleeve and the head assembly indexed so that the same or another dispensing closure is located above the flanged sleeve, and the filling head assembly is lowered to re-insert the dispensing closure into the flanged sleeve. The movement of the closure grip means is between three effective levels, that is, an intermediate level wherein it accepts the dispensing closure, an upper level at which the dispensing closure is lifted away from the flanged sleeve, and a lower level at which the dispensing closure is inserted into the flanged sleeve sufficiently for the shoulder to retain the dispensing closure against further removal.

More specifically, in this invention, a filling machine comprises a frame, sleeve retaining means on the frame of such shape and size that it is effective in releasably retaining the flanged sleeve of a container, a head assembly comprising closure grip means and a filling head, co-operable guide means respectively on the frame and head assembly guiding the head assembly for planar movement in a plane and linear movement in a direction at right angles thereto, and limit means limiting said linear movement to movement between three levels, slave power means operably coupled between the frame and head assembly to effect said movements and also to effect said filling of the container, and master control means coupled to said slave power means and arranged to effect said head movement so as to remove said dispensing closure from said flanged sleeve between an intermediate level and an upper level, to effect said planar movement and cause filling of a container with said filling head, and to effect further said planar movement and linear movement so as to reinsert said dispensing closure into said flanged sleeve to a lower level.

With this invention it is possible to greatly reduce the amount of operator fatique and at the same time increase production rates. By having the head linear movement taking place between three levels as defined above, excessive pressures are avoided against the dispensing closure, and high speed operation can be achieved with a minimum of likelihood of damage to that element of the container.

An embodiment of the invention is described hereunder in some detail with reference to and as illustrated in the accompanying drawings, in which:

FIG. 1 is a diagrammatic elevation showing the first stage of the method of filling a container with a liquid filling machine, that is gripping the sleeve of a container in the sleeve retaining means on the frame of a filling machine, FIG. 2 diagrammatically illustrates a second stage wherein the dispensing closure is removed from the flanged sleeve, FIG. 3 illustrates a further stage wherein a filling head is lowered over the flanged sleeve and the container is evacuated of air, FIG. 4 illustrates a still further stage wherein the filling head valve is opened and liquid is filled into the container bag, FIG. 5 illustrates a further stage wherein the liquid within the container bag is purged with the nitrogen, FIG. 6 illustrates a further stage wherein the dispensing closure is reinserted into the flanged sleeve, FIG. 7 is a diagrammatic plan view which illustrates a final stage wherein the container is ejected from the sleeve retaining means, FIG. 8 is a fragmentary elevation through the machine illustrating the frame, head assembly, and the slave power means operatively coupled between the frame and head assembly.

Figure 1:
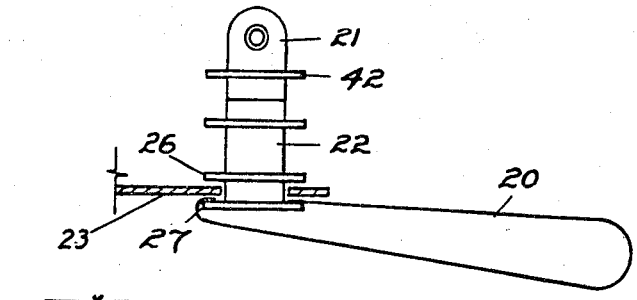

Referring first to the diagrammatic representations of FIGS. 1 through to 7, a container 20 is a flexible bag of polymeric material that is provided with a dispensing closure 21 which is axially movable into or out of a flanged sleeve 22. This is typical of many containers which are in common use, and which are particularly adapted for use with this invention.

Figure 7:
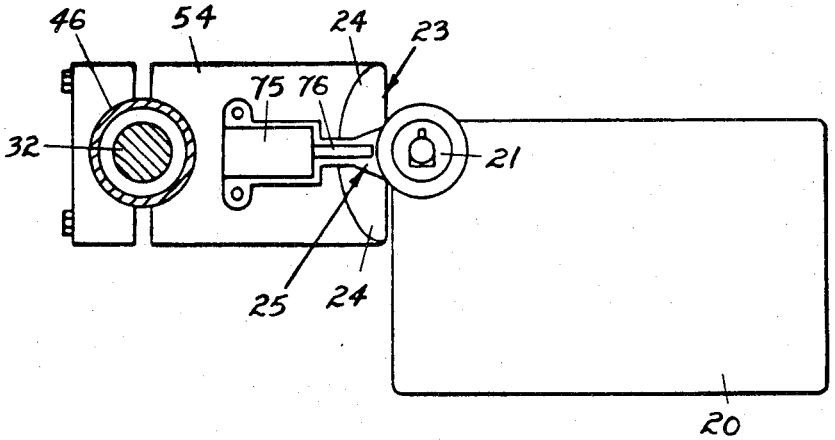
Figure 8:
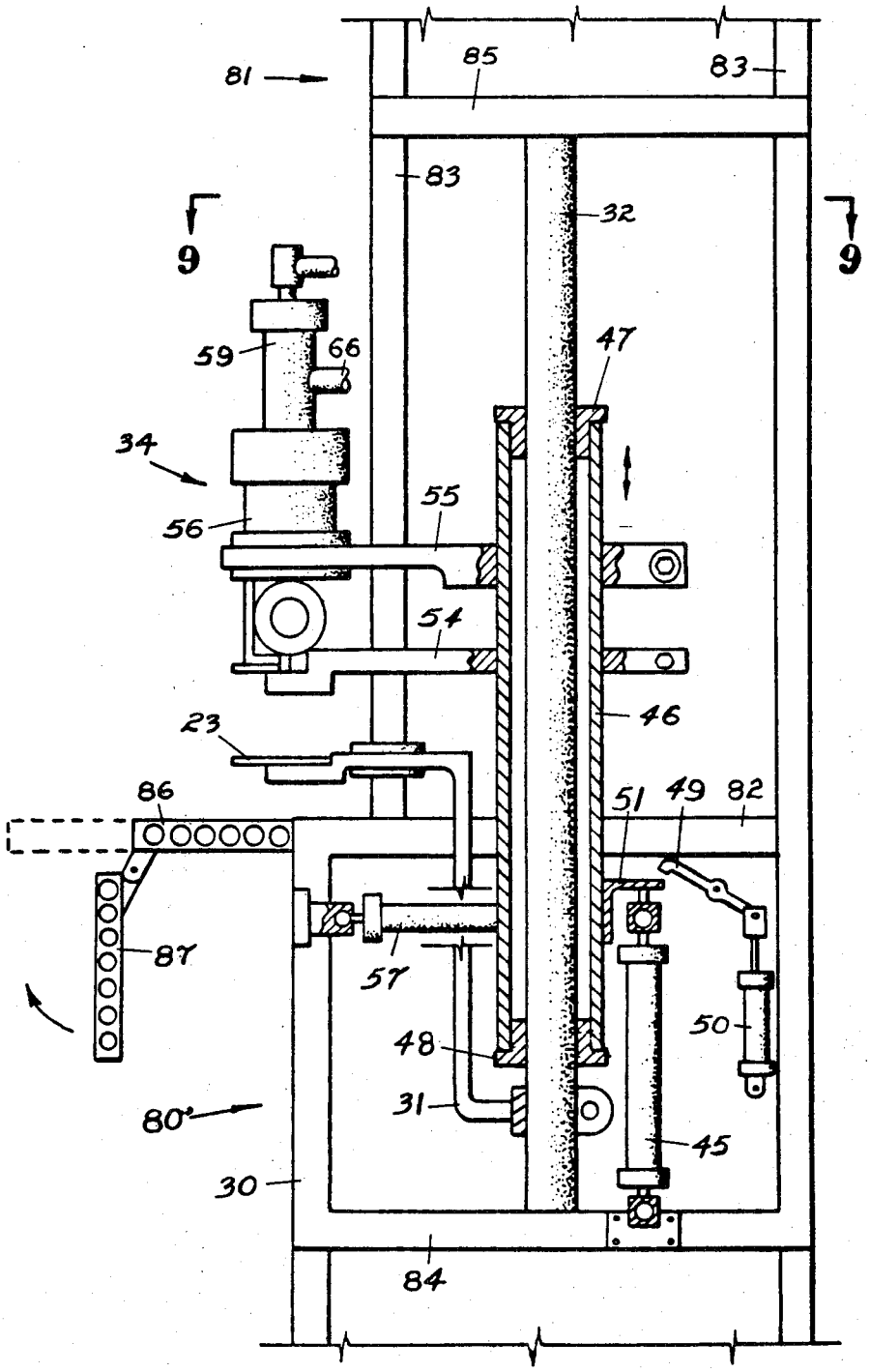

The first step in the filling of the container 20 is to position the flanged sleeve 22 over sleeve retaining means 23, which, as shown in FIG. 7, comprise two plate-like members 24 spaced from one another and defining between them a recess 25 which accepts the flanged sleeve 22 between its two flanges 26 and 27. The sleeve retaining means 23 is fixed with respect to the frame 30 of the machine by a clamping bracket 31 which clamps around a post 32 on the frame 30, whereby it is adjustable for position with respect to the post 32 by swivelling around the post 32 and by being raised or lowered. This is best seen in FIG. 8 of the drawings.

Figure 2:
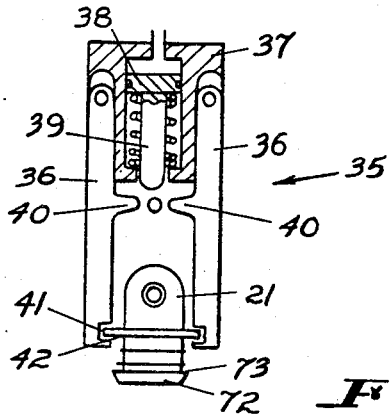

After the container has been so positioned, a head assembly 34 is lowered, the head assembly 34 having on it a closure grip means 35 which comprises four recessed fingers 36, pivoted at their upper ends to the outer wall of a cylinder 37 which contains a spring loaded piston 38, the stem 39 of which has a bull nose and which urges against inwardly directed projections 40 which are effective in opening the fingers 36 with respect to the central axis of the cylinder 37, and, upon relaxation of the piston 38, allowing them to again close to the position shown in FIG. 2 wherein the recesses 41 accommodate the flange 42 of the dispensing closure 21. The head moves from its intermediate position of FIG. 1 to its upper level when it is as shown in FIG. 2, and this causes the fingers 36 to lift the dispensing closure away from its flanged sleeve 22. This is achieved by means of an elevating cylinder 45 which is mounted to the frame 30 and also to a tubular column 46 which has bushes 47 and 48 at its upper and lower ends which slide and swivel around the fixed post 32. As shown in FIG. 1, the sleeve retaining means 23 is in an intermediate position, and this intermediate position is established by a latch 49 (also shown in FIG. 8) operated by a latch cylinder 50 which is shown withdrawn in FIG. 8, but which when in a lower position, limits upward movement of the bar 51 secured to the column 46 to establish the intermediate position, but when retracted as shown in FIG. 8 allows the column 46 together with its closure grip means 45 to raise to the position shown in FIG. 2.

Figure 3:
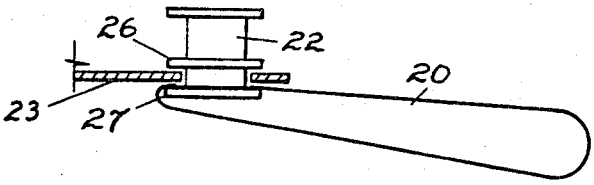
Figure 3:
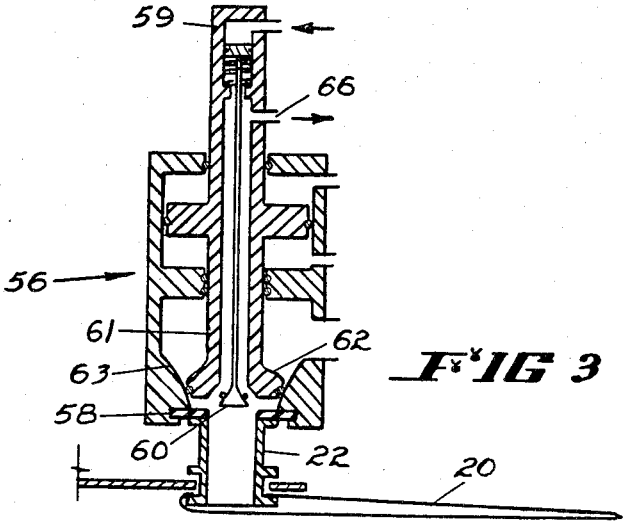
Figure 9:
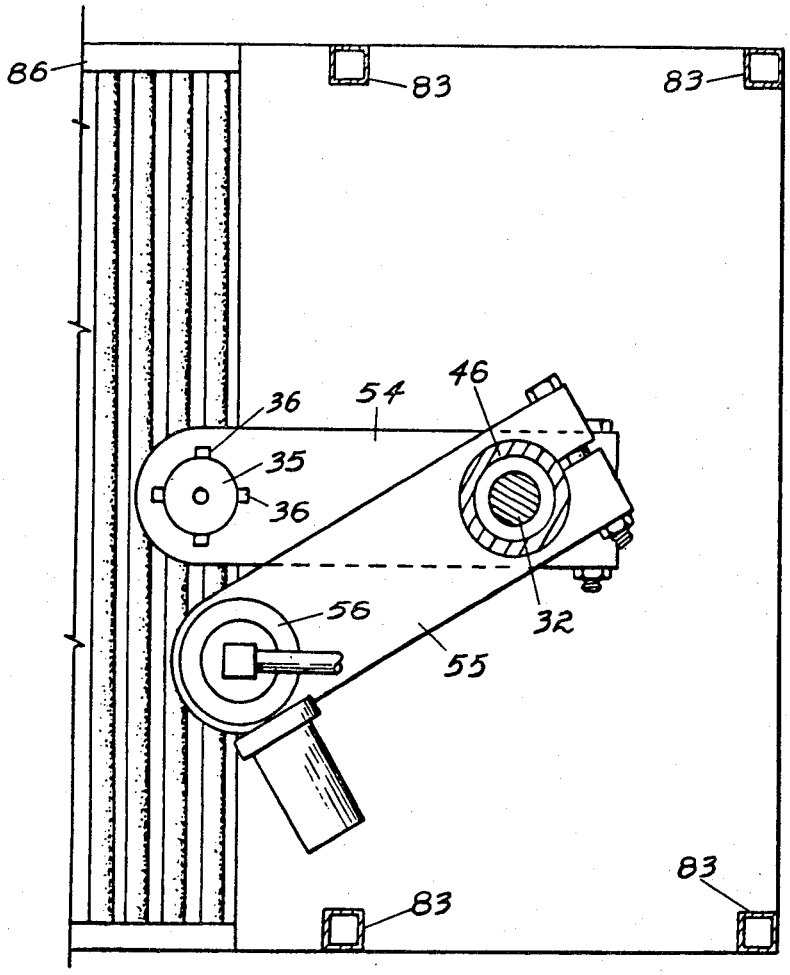
FIG. 9 is a section taken on line 9—9 of FIG. 8.

Referring now to FIG. 9, there are shown two arms designated 54 and 55, the lower arm 54 carrying on it the grip means 35 and the upper arm carrying on it a filler head 56. A rocking cylinder 57 (FIG. 8) rocks the two arms 54 and 55 from the position shown in FIG. 9 to the position where the filler head 56 is located to be coaxial with the flanged sleeve 22. When this occurs, the elevating cylinder 45 is again lowered, and the situation illustrated diagrammatically in FIG. 3 is achieved. The filler head 56 is lowered against the flanged sleeve 22, and the lower end which contacts the upper surface of the flanged sleeve 22 contains a soft resilient rubber sealing gasket 58 which seals against the flanged sleeve 22. At this stage, air is introduced into a small valving cylinder designated 59 which drives the piston rod downwardly and opens a gas valve 60 in the lower end of a major valve stem 61 which has on its lower end the liquid dispensing valve 62 which co-operates with a valve seat 63 in the lower end of the filler head 56. A gas flow conduit 66 leads to a venturi type evacuator on the frame of the machine (shown only in FIG. 10), and this evacuates air from the bag 20 so that there is little danger of oxygen encountering wine introduced into the bag.

Figure 4:
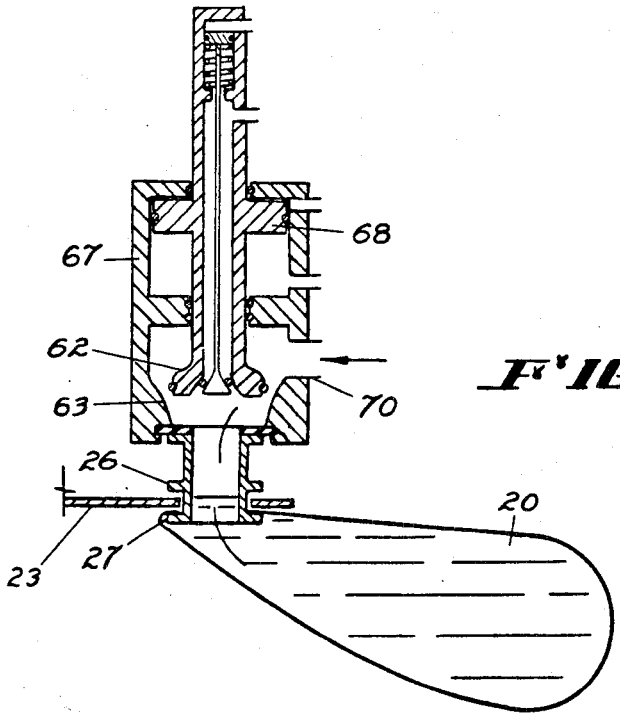

After a short period of time, the actuating air is removed from the valving cylinder 59 and the valve 60 closes. The stage of FIG. 4 is then reached, whereupon actuating air is valved into the filling head cylinder 67 (FIG. 4) to lift the piston 68 and thereby lift the liquid dispensing valve 62 from its valve seat 63, such that liquid flows through the liquid conduit 70 into the container 20. This stage of the sequence is illustrated in FIG. 4.

Figure 5:
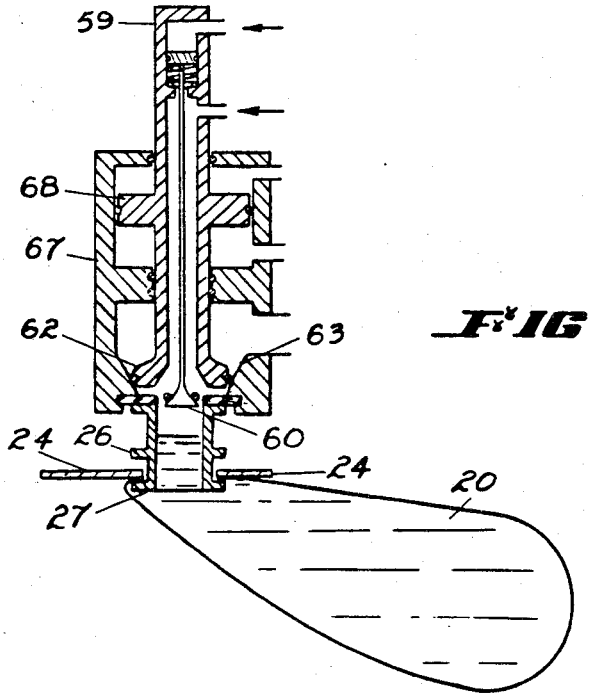

FIG. 5 illustrates the next stage in the sequence, wherein the piston 68 is again driven downwardly by air introduced into the top of the cylinder 67, and this closes the liquid dispensing valve 62 against the valve seat 63, to shut off the flow of liquid into the container after the correct amount has been metered out (or if a timer is used, has been timed out). Once again air is introduced into the valving cylinder 59 and this opens the gas valve 60. However, on the second occasion when the gas valve 60 is opened, the gas flow conduit 66 is connected, not to the venturi evacuator as in the first instance illustrated in FIG. 3, but to a supply of nitrogen gas and this purges the space above the level of the liquid in the container 20 of oxygen, thus reducing the probability of oxygen contamination of wine or other delicate product contained in the bag 20.

Figure 6:
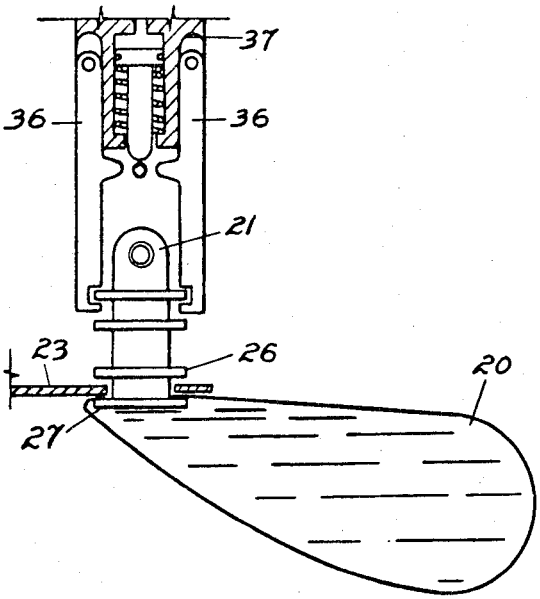

The next stage of the sequence is illustrated in FIG. 6 wherein the filling head 56 is lifted away from the flanged sleeve 22 and indexed back to the position shown in FIG. 9, by means of the rocking cylinder 57 (FIG. 8). Once again therefore, the closure grip means 35 is aligned with the polar axis of the flanged sleeve 22, and this is driven down as in the second stage of FIG. 2, but on this occasion the latch cylinder 50 is withdrawn as shown in FIG. 8, and the dispensing closure 21 is driven fully into the flange sleeve 22. As shown best in FIG. 2, the dispensing closure 21 terminates at its lower end in a tapered surface 72 which has an annular planar shoulder 73 thereon, and this inhibits further withdrawal of the dispensing closure 21 from the flanged sleeve 22.

The final stage is ejection of the now filled container bag 20, and this stage is illustrated diagrammatically in FIG. 7 wherein an ejection cylinder 75 is shown carried on the sleeve retaining means 23, and its piston rod 76 engages the flanged sleeve 22 and removes it from the plate-like jaws 24 in a lateral direction.

Reference is now made in more detail to the construction shown in FIGS. 8 and 9 of the drawings. The frame 30 comprises a lower portion generally designated 80, and an upper portion 81. The lower portion 80 supports a table 82, but there extends above the table 82 four posts 83 of the upper portion 81. Frame cross members 84 and 85 on the lower and upper portions respectively support between them the post 32. Forwardly of the table 82 there is provided a short fixed roll case 86 and hinged to this is a roll case extension 87, but the arrangement in front of the table 82 will need to be varied to suit varying plant requirements, and for example, in many instances there is provided a conveyor immediately adajcent the front edge of the table 82 onto which a filled bag is ejected.

It will be clear to those skilled in the art that the master control means can be either electronic or pneumatic or a combination of the two. In this embodiment, use is made of a combination of the two, and the main control is a pneumatic circuit which is illustrated in detail in FIG. 10. This is interfaced with a very simple electronic circuit which however is in accordance with known art, and is therefore not illustrated herein.

Figure 11:
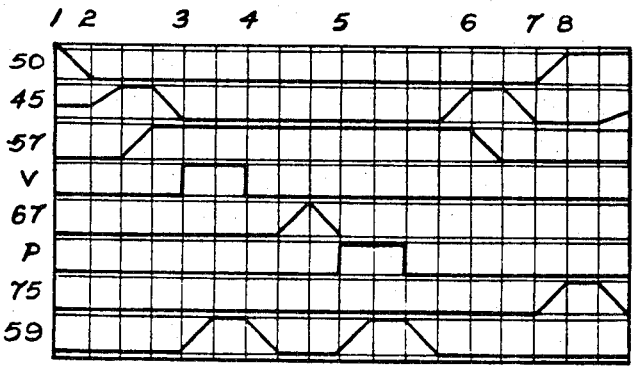
FIG. 11 is a sequence chart which shows diagrammatically the sequence of operation of six pneumatic cylinders which are embodied within the master control means and slave power means.
Figure 10:
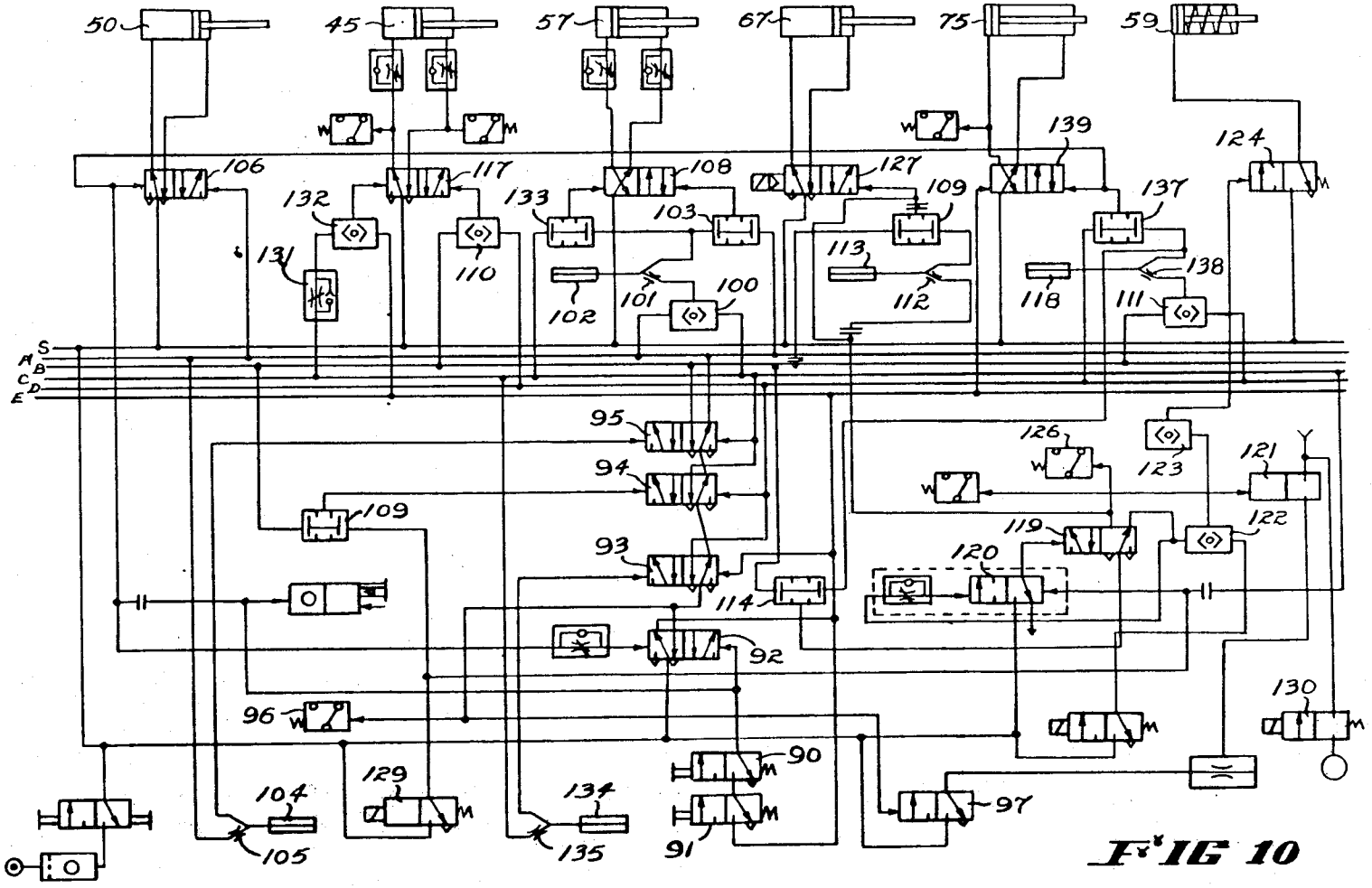
FIG. 10 is a circuit diagram of a pneumatic circuit which constitutes the major part of master control means which controls the slave power means.

Reference is therefore made to FIGS. 10 and 11, FIG. 10 illustrating the pneumatic logic circuit and FIG. 11 illustrating the various stages and the function of various operating cylinders. Across the top of FIG. 10 there are illustrated the following cylinders: latch cylinder 50, elevating cylinder 45 (which for part of its operation is in parallel with the finger actuating cylinder 37) the rocker or shift cylinder 57, the filling head cylinder 67, the ejection cylinder 75 and the valving cylinder 59 (which is associated at one stage of the cycle with evacuation and at the other stage with purge).

FIG. 11 illustrates in the ordinate, the cylinders 50, 45, 57, the cylinder 59 associated with valving, the cylinder 67, the cylinder 59 associated with purge and the cylinder 75, while the abscissa shows the stages 1 to 7 which correspond to FIGS. 1 to 7 in the drawings, and also stage 8 of the sequence.

The supply air line is marked on FIG. 10 with the letter S, and in addition to that there are five other airlines A, B, C, D, and E which are valved into or out of actuation by the master control logic circuit of FIG. 10.

In the condition shown in FIG. 1 of the drawings, the air is on to the supply line S, the latch cylinder 50 is extended and the lift cylinder 45 is energised so that the bar 51 (FIG. 8) is lifted up as far as the latch 49.

In the position of FIG. 2 of the drawings, after the product container has been inserted as illustrated in FIG. 1 the control push buttons 90 and 91 are depressed, receiving their air from the supply line S through the valve 92, and this first changes valve 92 to its alternative state allowing air to pass in cascade through the valves 93, 94 and 95, and this in turn energises the start indicator switch 96, the venturi evacuation valve 97 and also supplies air to the line A.

The air from line 1 passes through the OR gate 100 and through a flow sensor 101 to a bleed device 102, the bleed device 102 having an opening which is subsequently closed as disclosed hereunder. The air from the line 1 also passes through the AND gate 103, which also receives its AND gate function from the line A. Line A also supplies air to a second bleed device 104 through a second sensor 105, and changes over the valve 106 to its alternative state, retracting the cylinder 50 thereby removing the latch from interference with the lift cylinder, thereby allowing the lift (elevating cylinder) 45 to reach the top of its stroke by the precharged air therein, and lift the dispensing closure 21 from the flanged sleeve 22. This closes the bleed through the bleed device 102 and the AND gate function 103 is completed and valve 108 is changed over in its state allowing the rocker cylinder 57 to rock the head assembly 34 from the position shown in FIG. 9 to its alternative position wherein the filler head is co-axial with the flanged sleeve 22. The bleed device 104 is closed by the changing of the valve 95 to its alternative state, wherein it removes air from line A and energises line B.

The next stage which is identified in the drawings and in FIG. 11 as stage 3 is the evacuation stage, and air is supplied to the AND gate 109, to OR gate 110, to OR gate 111, to sensor 112, to the bleed device 113 and to AND gate function 114. The energising of line A supplies air to valve 117 via OR gate 110 changing the valve 117 in its state. This brings the filler head down to the top of the flanged sleeve 22, and in turn closes off the sensor bleed device 118 thereby completing the AND function of 114, thus supplying air to the valve 119 and from its outlet, energising the timer 120 for timing of evacuation time. Simultaneously, the vacuum indicator is energised through the vacuum valve 121 via the OR gate 122 and OR gate 123 to the spring return valve 124. The valve cylinder 59 is energised, and this allows evacuation to the venturi (not shown).

The next stage is the fourth stage illustrated in FIG. 4 and identified with the designation 4 in FIG. 11, that is, the fill stage.

Upon completion of the time period of the timer 120, the valve 119 changes state, energising the fill indicator 126, and via the bag sensor 112 and the bleed device 113, through the AND gate 109, completing the AND gate function to change the valve 127 state, allowing the liquid dispensing valve 62 to open by the retraction of the cylinder 67 with the fill indicator 126 being open, the electrical signals energises an electrical relay not herein shown. This relay enables a count from either of two sources, namely an internal test function clock pulses generator to allow the machine to be checked for operation without product or, when the valve 62 is open, a pulse is received from a sanitary turbine (not shown, but commonly used in the art) being generated by the flow of liquid being charged into the container. On reaching total count, a relay function takes place, and this energises a solenoid 129 and simultaneously energises a solenoid valve 130 for purging with nitrogen.

The next stage is stage 5 on the drawings and the chart of FIG. 11, that is, the purging stage. On energising of the solenoid 129, the AND gate function 109 is completed changing over the state of the valve 94, removing air from line B, and introducing it to line C via the OR gate 123, in turn energising the spring return valve 124. This actuates the valving cylinder 59 allowing the purged gas to flow on top of the product in the container. It also changes the state of valve 95 back to its earlier state.

The next stage is shown on FIG. 6 and illustrated by the designation 6 on FIG. 11, and this is the re-capping stage. On energising of line C, the valve on the cylinder 67 (the filling cylinder) has its state changed, and this is effected by changing the valve 127 thereby energising the elevating cylinder 45 by changing over its valve 117 via the flow restrictor 131 and the OR gate 132. It also supplies one half of the AND gate function of 133, supplying to the bleed device 134 by its sensor 135 to the bleed device 102 via the OR gate 100 and the sensor 101 and changes the state of the valve 119. After the delay of 131, the elevating cylinder 45 is energised, and this closes the bleed 102, completing the AND gate function of the valve 133 thus changing the state of the valve 108, energising the rocker cylinder 57 to retract, and closing the bleed 134. This changes the state of the valve 93 and subsequently changes the valve 94, removing air from line C and energising line D.

The next stage is the ejection stage, and on the energising of line D, the state of valve 117 is changed via the OR gate 110, this completing half of the AND gate function of the AND gate 137, and via the OR gate 117, and the sensor 138 to the bleed device 118. When the elevating cylinder 45 is retracted in the insertion stroke or the dispensing closure, it closes the bleed 118 and completes the AND gate function 137, this changes over the state of the valve 139 and energises the ejection cylinder 75, also changing the state of the valve 106 and extending the latch cylinder 50, resetting the latch in readiness for the acceptance position, via the flow regulator 140 which functions as an eject/lift time delay, and the valve 92 has its state changed. This changes the outlet of the valve removing air from line D and energising line E.

The final stage is not illustrated in the diagrammatic drawings, but is shown in stage 8 in FIG. 11, since it is a resetting stage. The system is re-set in readiness for the next container entry by energising the elevating cylinder 45 changing the state of the valve 117 via the OR gate 132, also changing the valve 139, supplying air in readiness for the next cycle.

Various modifications in structure and/or function may be made by one skilled in the art to the disclosed embodiments without departing from the scope of the invention as defined by the claims.

What is claimed is:

1. A liquid filling machine which is useful for filling, with liquid, a container of the type which has a dispensing closure axially movable into or out of a flanged sleeve, comprising:

a frame;

sleeve retaining means for releasably retaining said flanged sleeve;

a head assembly comprising closure grip means and a filling head, cooperable guide means respectively on the frame and head assembly for guiding the head assembly for planar movement in a horizontal plane and linear movement in a vertical direction at right angles thereto, and limit means for limiting the linear movement to movement between three levels, respectively a lower level, an intermediate level and an upper level;

slave power means operably coupled between the frame and head assembly for effecting said movements and also to effect said filling of the container;

and master control means coupled to said slave power means for effecting said head linear movement so as lift said dispensing closure from said flanged sleeve between said intermediate level and said upper level, thereafter effecting said planar movement of said head assembly to remove said dispensing closure from the locality of said flanged sleeve and position said filling head over said sleeve, thereafter causing the filling of the container with said filling head and thereafter effecting said planar movement in reverse and then a downward linear movement to the lower level so as to reinsert said dispensing closure into said flanged sleeve.

2. A liquid filling machine according to claim 1 further comprising gas control means having a valve, and a conduit extending to said head assembly, said gas control means comprising evacuator means also controlled by said master means to evacuate air from said container after said removal of the dispensing closure from the flanged sleeve and before said filling of the container.

3. A liquid filling machine according to claim 2 further comprising an inert gas source coupled to said gas control means and controlled thereby to purge the space in said container after said filling thereof, but before said reinserting of the dispensing closure.

4. A liquid filling machine according to claim 1 wherein said sleeve retaining means comprises a pair of spaced plate-like jaws defining between them a recess of such width that it accepts said flanged sleeve with flanges thereof above and below, but contiguous with said plate-like jaws, and securing means securing the plate-like jaws to the frame of the machine.

5. A liquid filling machine according to claim 4 wherein said sleeve retaining means further comprises an ejection cylinder and piston rod assembly.

6. A liquid filling machine according to claim 1 or claim 2 wherein said head assembly closure grip means comprises a plurality of fingers each having edges defining a respective recess, and a piston/cylinder combination operatively engageable aginst the fingers to control movement between retracted positions and flange engaging positions, the finger recesses being located over a flange of said dispensing closure when the fingers are in a flange engaging position.

7. A liquid filling machine according to claim 1 wherein said frame comprises a vertical post of circular cross-section, and said co-operable guide means comprises a sleeve surrounding the post, arms extending from the sleeve carrying the closure grips means and the filling head in circumferentially spaced relationship with one another but spaced equally radially from the sleeve, bushes interposed between the sleeve and the post guiding the sleeve for slidable movement over the post and also for rocking movement about the post.

8. A liquid filling machine according to claim 7 further comprising a latch, a piston/cylinder combination on the frame carrying the latch, a rocker piston/cyinder combination operatively interposed between the frame and the sleeve operable to effect said rocking movement of the sleeve about the post and thereby effect said planar movement, an elevating piston/cylinder combination also operatively interposed between the frame and the sleeve operable to effect said slidable movement of the sleeve and thus said linear movement of the head assembly, said latch in its operative position limiting sleeve movement to said intermediate level, but when in its retracted position allowing sleeve movement between said upper and lower levels.

9. A liquid filling machine according to claim 1 wherein said filling head comprises a flange sealing gasket which sealably engages an upper surface of said flanged sleeve when the head is in said intermediate position, a piston actuated liquid dispensing valve member movable between an open position and a closed position and being operable to control liquid flow into said container, and a piston actuated gas valve carried by said liquid dispensing valve member operable to control gas flow into and out of said container.

10. A liquid filling machine accordng to claim 1 or claim 9 wherein said master control means comprises a sequential pneumatic logic circuit.

11. A method of filling, with liquid, a container of the type which has a dispensing closure axially movable into or out of a flanged sleeve, comprising:

locating the sleeve on sleeve retaining means so as to releasably retain the sleeve in a position fixed relative to a frame of a liquid filling machine, lowering closure grip means of a head assembly of said machine from an upper level to an intermediate level over said closure and gripping said closure with said grip means, raising said closure grip means vertically to said upper level to remove said closure from said flanged sleeve, moving said closure grip means in a horizontal plane away from alignment with said flanged sleeve and at the same time bringing a filling head into alignment therewith, lowering said head assembly to said intermediate level and thereby bringing said filler head into sealable engagement with an upper surface of said flanged sleeve, evacuating air from said container through said filler head, and filling the container with liquid, lifting said head assembly back to its upper level and returning said closure grip means to vertical alignment with said flanged sleeve, and lowering said head assembly to a lower level to reinsert said closure into said flanged sleeve, releasing said closure grip means from said closure, raising said filler head to its upper level, and removing the filled container from said sleeve retaining means.

* * * * *